US012061004B2

(12) United States Patent
Zhuo et al.

(10) Patent No.: US 12,061,004 B2
(45) Date of Patent: Aug. 13, 2024

(54) EXPANSION VALVE CONTROL METHOD FOR MULTI-CONNECTION AIR-CONDITIONING SYSTEM

(71) Applicants: Qingdao Haier Air-conditioning Electronic Co., Ltd, Shandong (CN); Haier Smart Home Co., Ltd., Shandong (CN)

(72) Inventors: Baitian Zhuo, Qingdao (CN); Bin Shi, Qingdao (CN); Shaojiang Cheng, Qingdao (CN); Ruigang Zhang, Qingdao (CN); Jun Wang, Qingdao (CN)

(73) Assignees: Qingdao Haier Air-conditioning Electronic Co., Ltd, Qingdao (CN); Haier Smart Home Co., Ltd., Qingdao (CN)

( * ) Notice: Subject to any disclaimer, the term of this patent is extended or adjusted under 35 U.S.C. 154(b) by 301 days.

(21) Appl. No.: 17/629,509

(22) PCT Filed: Jul. 10, 2020

(86) PCT No.: PCT/CN2020/101316
§ 371 (c)(1),
(2) Date: Jan. 24, 2022

(87) PCT Pub. No.: WO2021/012967
PCT Pub. Date: Jan. 28, 2021

(65) Prior Publication Data

US 2022/0282885 A1 Sep. 8, 2022

(30) Foreign Application Priority Data

Jul. 23, 2019 (CN) ..... 201910667960.6

(51) Int. Cl.
*F24F 11/64* (2018.01)
*F24F 11/61* (2018.01)
(Continued)

(52) U.S. Cl.
CPC ..... *F24F 11/64* (2018.01); *F24F 11/61* (2018.01); *F24F 11/67* (2018.01); *F24F 11/84* (2018.01);
(Continued)

(58) Field of Classification Search
CPC ..... F24F 41/31; F24F 2110/10; F24F 11/84; F24F 11/67; F24F 11/64; F24F 11/61; F25B 49/02; F25B 41/31; F25B 2600/2513
See application file for complete search history.

(56) References Cited

FOREIGN PATENT DOCUMENTS

CN 105485869 A 4/2016
CN 105953483 A * 9/2016 ..... F24F 11/30
(Continued)

OTHER PUBLICATIONS

Wang, Multiple-on-line system and failure detection method for throttling elements of indoor units of multiple-on-line system, 2016, Full Document (Year: 2016).*
(Continued)

*Primary Examiner* — Nael N Babaa
(74) *Attorney, Agent, or Firm* — Maier & Maier, PLLC

(57) ABSTRACT

An expansion valve control method for a multi-split air-conditioning system to solve the problem of detecting leakage of an expansion valve of a multi-split air-conditioning system. The system includes an outdoor unit and a plurality of indoor units connected to the outdoor unit, each of the indoor units is connected to the outdoor unit by a first pipeline and a second pipeline. The expansion valve control method includes acquiring an indoor temperature of an
(Continued)

environment where an indoor unit is located; acquiring the temperature of a first pipeline of the indoor unit and the temperature of a second pipeline of the indoor unit when the indoor unit is in a shutdown state; and according to at least the indoor temperature of the environment where the indoor unit is located, determining the leakage condition of an expansion valve of the indoor unit.

13 Claims, 4 Drawing Sheets

(51) Int. Cl.

| | |
|---|---|
| ***F24F 11/67*** | (2018.01) |
| ***F24F 11/84*** | (2018.01) |
| ***F25B 41/31*** | (2021.01) |
| ***F25B 49/02*** | (2006.01) |
| *F24F 110/10* | (2018.01) |

(52) U.S. Cl.
CPC ..... *F25B 41/31* (2021.01); *F25B 49/02* (2013.01); *F24F 2110/10* (2018.01); *F25B 2600/2513* (2013.01)

(56) References Cited

FOREIGN PATENT DOCUMENTS

| | | | | |
|---|---|---|---|---|
| CN | 105953483 | A | | 9/2016 |
| CN | 109405173 | A | * | 3/2019 |
| CN | 109405173 | A | | 3/2019 |
| JP | 2003294293 | A | | 10/2003 |
| JP | 2009145005 | A | | 7/2009 |

OTHER PUBLICATIONS

Huang, A kind of detection method and multi-online air-conditioning system of the interior leakage of electric expansion valve, 2018, Full Document (Year: 2018).*

International Search Report issued on Oct. 12, 2020 in corresponding International Application No. PCT/CN2020/101316; 6 pages.

* cited by examiner

EXPANSION VALVE CONTROL METHOD FOR MULTI-CONNECTION AIR-CONDITIONING SYSTEM

FIELD

The present disclosure belongs to the technical field of heat exchange, and specifically relates to an expansion valve control method for a multi-connection air conditioning system.

BACKGROUND

In order to maintain a comfortable ambient temperature, an air conditioner has become an indispensable device in people's lives. In recent years, in order to effectively improve heat exchange efficiency and save heat exchange cost, multi-connection air conditioning systems have received wider and wider applications. Generally, a multi-connection air conditioning system includes an outdoor unit and a plurality of indoor units connected to the outdoor unit, and each of the indoor units is equipped with an expansion valve to control a flow rate of refrigerant between the outdoor unit and each of the indoor units. When a certain indoor unit starts to operate, the air conditioning system can control the flow rate of the refrigerant in the indoor unit by controlling the expansion valve of the indoor unit. At the same time, when a certain indoor unit is turned off, if the entire air conditioning system is in a state of cooling operation, the expansion valve of this indoor unit needs to be completely closed, and if the entire air conditioning system is in a state of heating operation, the expansion valve of this indoor unit needs to maintain a small opening degree. However, the expansion valve of the existing multi-connection air conditioning system often fails to reach a preset closing degree due to a leakage problem, which leads to fault of the entire air conditioning system.

Specifically, when a certain indoor unit is turned off, if the entire air conditioning system is in the state of cooling operation, and the expansion valve of this indoor unit is not completely closed due to leakage, the air conditioning system is prone to a flood-back problem, which would even cause a compressor to be burned due to liquid shock in severe cases; meanwhile, if the entire air conditioning system is in the state of heating operation, and the expansion valve of this indoor unit is not closed to a preset opening degree due to leakage, it will easily cause the problem that other indoor units in the turned-on state have a poor heating effect, and may even cause abnormal pressure parameters of the entire air conditioning system, thereby affecting the normal operation of the compressor. It can be known from above that once the expansion valve of the indoor unit has the leakage problem, the compressor of the air conditioning system may be easily burned, which will seriously affect the user experience. Therefore, it can be seen that it is particularly important to detect the leakage condition of the expansion valve timely and accurately and to perform an effective automatic repair operation in time after the leakage of the expansion valve is detected.

Accordingly, there is a need for a new expansion valve control method for a multi-connection air conditioning system in the art to solve the above problem.

SUMMARY

In order to solve the above problem in the prior art, that is, in order to solve the problem that it is difficult for existing detection methods to accurately and timely detect leakage of an expansion valve of a multi-connection air conditioning system, the present disclosure provides an expansion valve control method for a multi-connection air conditioning system, the multi-connection air conditioning system including an outdoor unit and a plurality of indoor units connected to the outdoor unit, each of the indoor units being connected to the outdoor unit through a first pipeline and a second pipeline, and the expansion valve control method including: obtaining an indoor temperature of an environment in which the indoor unit is located; obtaining a temperature of the first pipeline of the indoor unit and a temperature of the second pipeline of the indoor unit when the indoor unit is in a turned-off state; and determining a leakage condition of an expansion valve of the indoor unit according to the indoor temperature of the environment in which the indoor unit is located, the temperature of the first pipeline of the indoor unit, and the temperature of the second pipeline of the indoor unit.

In a preferred technical solution of the above expansion valve control method for the multi-connection air conditioning system, when the indoor unit is in a cooling mode, the step of "determining the leakage condition of the expansion valve of the indoor unit according to the indoor temperature of the environment in which the indoor unit is located, the temperature of the first pipeline of the indoor unit, and the temperature of the second pipeline of the indoor unit" specifically includes: determining the leakage condition of the expansion valve of the indoor unit according to a difference between the temperature of the first pipeline of the indoor unit and the temperature of the second pipeline of the indoor unit, and a difference between the indoor temperature of the environment in which the indoor unit is located and the temperature of the first pipeline of the indoor unit or a difference between the indoor temperature of the environment in which the indoor unit is located and the temperature of the second pipeline of the indoor unit.

In a preferred technical solution of the above expansion valve control method for the multi-connection air conditioning system, the step of "determining the leakage condition of the expansion valve of the indoor unit according to the difference between the temperature of the first pipeline of the indoor unit and the temperature of the second pipeline of the indoor unit, and the difference between the indoor temperature of the environment in which the indoor unit is located and the temperature of the first pipeline of the indoor unit or the difference between the indoor temperature of the environment in which the indoor unit is located and the temperature of the second pipeline of the indoor unit" specifically includes: if a duration in which a first cooling difference is larger than or equal to a first preset cooling difference and smaller than a second preset cooling difference reaches a first preset duration, and a duration in which a second cooling difference is larger than a third preset cooling difference and smaller than or equal to a fourth preset cooling difference reaches the first preset duration or a duration in which a third cooling difference is larger than a fifth preset cooling difference and smaller than or equal to a sixth preset cooling difference reaches the first preset duration, then determining that the expansion valve of the indoor unit is in a mild leakage state; if a duration in which the first cooling difference is larger than or equal to a seventh preset cooling difference and smaller than the first preset cooling difference reaches the first preset duration, and a duration in which the second cooling difference is larger than the fourth preset cooling difference and smaller than or equal to an eighth preset cooling difference reaches the first preset duration or a duration in which the third cooling difference is larger than the sixth preset cooling difference and smaller than or equal to a ninth preset cooling difference reaches the first preset duration, then determining that the expansion valve of the indoor unit is in a moderate leakage state; and if a duration in which the first cooling difference is smaller than the seventh preset cooling difference reaches the first preset duration, and a duration in which the second cooling difference is larger than the eighth preset cooling difference reaches the first preset duration or a duration in which the third cooling difference is larger than the ninth preset cooling difference reaches the first preset duration, then determining that the expansion valve of the indoor unit is in a severe leakage state; in which the first cooling difference is the difference between the temperature of the first pipeline of the indoor unit and the temperature of the second pipeline of the indoor unit, the second cooling difference is the difference between the indoor temperature of the environment in which the indoor unit is located and the temperature of the first pipeline of the indoor unit, and the third difference is the difference between the indoor temperature of the environment in which the indoor unit is located and the temperature of the second pipeline of the indoor unit.

In a preferred technical solution of the above expansion valve control method for the multi-connection air conditioning system, when the indoor unit is in a heating mode, the step of "determining the leakage condition of the expansion valve of the indoor unit according to the indoor temperature of the environment in which the indoor unit is located, the temperature of the first pipeline of the indoor unit, and the temperature of the second pipeline of the indoor unit" specifically includes: determining the leakage condition of the expansion valve of the indoor unit according to a difference between the temperature of the first pipeline of the indoor unit and the temperature of the second pipeline of the indoor unit, and a difference between the temperature of the second pipeline of the indoor unit and the indoor temperature of the environment in which the indoor unit is located.

In a preferred technical solution of the above expansion valve control method for the multi-connection air conditioning system, the step of "determining the leakage condition of the expansion valve of the indoor unit according to the difference between the temperature of the first pipeline of the indoor unit and the temperature of the second pipeline of the indoor unit, and the difference between the temperature of the second pipeline of the indoor unit and the indoor temperature of the environment in which the indoor unit is located" specifically includes: if a duration in which a first heating difference is larger than a first preset heating difference reaches a second preset duration, and a duration in which a second heating difference is larger than a second preset heating difference and smaller than or equal to a third preset heating difference reaches the second preset duration, then determining that the expansion valve of the indoor unit is in a mild leakage state; if a duration in which the first heating difference is larger than a fourth preset heating difference and smaller than or equal to the first preset heating difference reaches the second preset duration, and a duration in which the second heating difference is larger than the third preset heating difference and smaller than or equal to a fifth preset heating difference reaches the second preset duration, then determining that the expansion valve of the indoor unit is in a moderate leakage state; and if a duration in which the first heating difference is larger than a sixth preset heating difference and smaller than or equal to the fourth preset heating difference reaches the second preset duration, and a duration in which the second heating difference is larger than the fifth preset heating difference reaches the second preset duration, then determining that the expansion valve of the indoor unit is in a severe leakage state; in which the first heating difference is the difference between the temperature of the first pipeline of the indoor unit and the temperature of the second pipeline of the indoor unit, and the second heating difference is the difference between the temperature of the second pipeline of the indoor unit and the indoor temperature of the environment in which the indoor unit is located.

In a preferred technical solution of the above expansion valve control method for the multi-connection air conditioning system, the first preset cooling difference is −1° C., the second preset cooling difference is −0.5° C., the third preset cooling difference is 4° C., the fourth preset cooling difference is 6° C., the fifth preset cooling difference is 5° C., the sixth preset cooling difference is 8° C., the seventh preset cooling difference is −3° C., the eighth preset cooling difference is 8° C., the ninth preset cooling difference is 10° C., and the first preset duration is 5 minutes; or the first preset heating difference is 10° C., the second preset heating difference is 20° C., the third preset heating difference is 25° C., the fourth preset heating difference is 7° C., the fifth preset heating difference is 30° C., the sixth preset heating difference is 5° C., and the second preset duration is 5 minutes.

In a preferred technical solution of the above expansion valve control method for the multi-connection air conditioning system, if the expansion valve of the indoor unit is in the mild leakage state, the expansion valve control method further includes: controlling the expansion valve to be closed by a first preset opening degree; and executing the above step again, if the expansion valve is still in the mild leakage state after a third preset duration has elapsed.

In a preferred technical solution of the above expansion valve control method for the multi-connection air conditioning system, if the expansion valve of the indoor unit is in the moderate leakage state, the expansion valve control method further includes: controlling the expansion valve to be closed by a second preset opening degree; and executing the above step again, if the expansion valve is still in the leakage state after a fourth preset duration has elapsed, the second preset opening degree being larger than the first preset opening degree.

In a preferred technical solution of the above expansion valve control method for the multi-connection air conditioning system, if the expansion valve is still in the leakage state in a case where the number of times the expansion valve is controlled to be closed by the second preset opening degree reaches a first preset number of times, the control method further includes: controlling the expansion valve to be opened by a third preset opening degree; controlling a fan of the indoor unit to be turned on; controlling the expansion valve to be closed by a fourth preset opening degree after a fifth preset duration has elapsed; controlling the fan of the indoor unit to be turned off; and executing the above steps again, if the expansion valve is still in the leakage state after a sixth preset duration has elapsed, the fourth preset opening degree being larger than the third preset opening degree.

In a preferred technical solution of the above expansion valve control method for the multi-connection air conditioning system, if the expansion valve of the indoor unit is in the severe leakage state, the expansion valve control method further includes: controlling the expansion valve to be opened by a fifth preset opening degree; controlling a fan of the indoor unit to be turned on; controlling the expansion valve to be closed by a sixth preset opening degree after a seventh preset duration has elapsed; controlling the fan of the indoor unit to be turned off; and executing the above steps again, if the expansion valve is still in the leakage state after an eighth preset duration has elapsed, the sixth preset opening degree being larger than the fifth preset opening degree.

It can be understood by those skilled in the art in the technical solutions of the present disclosure, the multi-connection air conditioning system of the present disclosure includes an outdoor unit and a plurality of indoor units connected to the outdoor unit, each of the indoor units is connected to the outdoor unit through a first pipeline and a second pipeline, and the expansion valve control method of the present disclosure includes: obtaining an indoor temperature of an environment in which the indoor unit is located; obtaining a temperature of the first pipeline of the indoor unit and a temperature of the second pipeline of the indoor unit when the indoor unit is in a turned-off state; and determining a leakage condition of the expansion valve of the indoor unit according to the indoor temperature of the environment in which the indoor unit is located, the temperature of the first pipeline of the indoor unit, and the temperature of the second pipeline of the indoor unit. It can be understood that regardless of whether the multi-connection air conditioning system is in a cooling mode or a heating mode, circulation of refrigerant between each of the indoor units and the outdoor unit needs to be controlled by the expansion valve of each of the indoor units. When the circulation of the refrigerant between the indoor unit and the outdoor unit is different, the temperature of the first pipeline of the indoor unit and the temperature of the second pipeline of the indoor unit are naturally different. Therefore, by combining the indoor temperature of the environment in which the indoor unit is located with inlet and outlet temperatures of the indoor unit, the present disclosure accurately judges the leakage condition of the expansion valve of the indoor unit; at the same time, since the temperatures change in real time, the present disclosure can judge the leakage condition of the expansion valve of each indoor unit more timely through the temperature values.

DETAILED DESCRIPTION

Preferred embodiments of the present disclosure are described below with reference to the drawings. It should be understood by those skilled in the art that these embodiments are only used to explain the technical principles of the present disclosure, and are not intended to limit the scope of protection of the present disclosure. For example, although various steps of the method of the present disclosure are described in specific orders in the present application, these orders are not limitative, and those skilled in the art can execute said steps in different orders without departing from the basic principles of the present disclosure.

Figure 1:
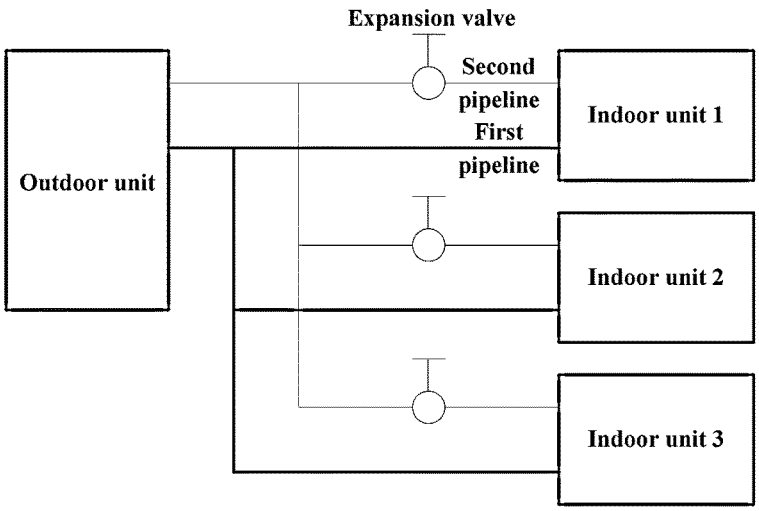
FIG. 1 is a schematic structural diagram of a multi-connection air conditioning system of the present disclosure.

Firstly, reference is made to FIG. 1, which is a schematic structural diagram of a multi-connection air conditioning system of the present disclosure. As shown in FIG. 1, the multi-connection air conditioning system of the present disclosure includes an outdoor unit and a plurality of indoor units connected to the outdoor unit; it should be noted that the present disclosure does not impose any restrictions on the number of the indoor units included in the multi-connection air conditioning system, and the number may be flexibly set by technicians according to actual requirements on use. Taking the indoor unit 1 as an example, the indoor unit 1 is connected to the outdoor unit through a first pipeline and a second pipeline, and an expansion valve of the indoor unit 1 is provided on the second pipeline. When the indoor unit 1 is operating in a cooling mode, the first pipeline is an air outlet pipeline, and the second pipeline is a liquid inlet pipeline; and when the indoor unit 1 is operating in a heating mode, the first pipeline is an air inlet pipeline, and the second pipeline is a liquid outlet pipeline. It can be understood by those skilled in the art that the present disclosure does not impose any restrictions on the specific structures of the first pipeline and the second pipeline. The technicians may set the specific structure of the multi-connection air conditioning system according to actual requirements on use. Such changes to the structure do not deviate from the basic principles of the present disclosure, and should belong to the scope of protection of the present disclosure.

Further, still taking the indoor unit 1 as an example, the multi-connection air conditioning system of the present disclosure further includes a first temperature sensor, a second temperature sensor, and a first indoor temperature sensor. The first temperature sensor can detect a temperature of the first pipeline of indoor unit 1, the second temperature sensor can detect a temperature of the second pipeline of the indoor unit 1, and the first indoor temperature sensor can detect an indoor temperature of a room in which the indoor unit 1 is located. It should be noted that the present disclosure does not impose any restrictions on the specific types of the first temperature sensor, the second temperature sensor, and the first indoor temperature sensor, and technicians may select the specific types by themselves according to actual requirements on use. The multi-connection air conditioning system further includes a controller that can obtain detection data of the first temperature sensor, the second temperature sensor and the first indoor temperature sensor, and the controller can also control the operation of the multi-connection air conditioning system; for example, it can control an opening degree of the expansion valve of the indoor unit 1 and the like. In addition, it can be understood by those skilled in the art that the present disclosure does not impose any restrictions on the specific structure and model of the controller, and the controller may be an original controller of the air conditioning system, or it may also be a controller separately provided to implement the expansion valve control method of the present disclosure. Technicians may set the specific structure and model of the controller by themselves according to actual requirements on use.

Figure 2:
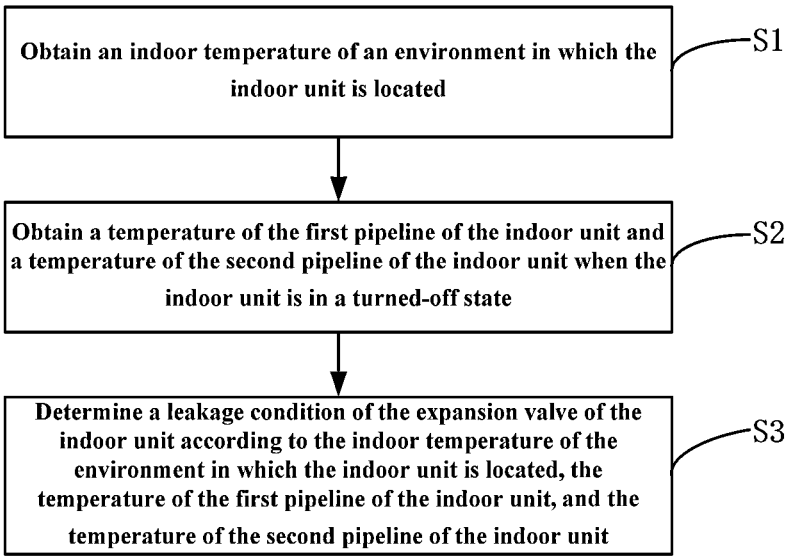
FIG. 2 is a flowchart showing main steps of an expansion valve control method of the present disclosure.

Now reference is made to FIG. 2, which is a flowchart showing main steps of the expansion valve control method of the present disclosure. As shown in FIG. 2, based on the structure of the multi-connection air conditioning system described in the above preferred embodiment, the expansion valve control method mainly includes the following steps:

S1: obtaining an indoor temperature of an environment in which the indoor unit is located;

S2: obtaining a temperature of the first pipeline of the indoor unit and a temperature of the second pipeline of the indoor unit when the indoor unit is in a turned-off state; and S3: determining a leakage condition of the expansion valve of the indoor unit according to the indoor temperature of the environment in which the indoor unit is located, the temperature of the first pipeline of the indoor unit, and the temperature of the second pipeline of the indoor unit.

Further, taking the determination of the leakage condition of the expansion valve of the indoor unit 1 as an example, in step S1, the controller can obtain the indoor temperature of the room in which the indoor unit 1 is located through the first indoor temperature sensor; it can be understood that the indoor temperature of the room in which the indoor unit 1 is located will inevitably have a certain influence on the temperature of the first pipeline and the temperature of the second pipeline of the indoor unit 1. Therefore, if the temperature of the first pipeline and the temperature of the second pipeline are used alone, a misjudgment is easily caused; in order to effectively ensure the accuracy of the judgment result, the present disclosure also collects the indoor temperature of the room in which the indoor unit 1 is located to serves as a basic parameter for participating in the judgment. Of course, it should be noted that the present disclosure does not impose any restrictions on the way in which the controller obtains the indoor temperature. Technicians may obtain the indoor temperature of the room in which the indoor unit 1 is located through the temperature sensor provided by the multi-connection air conditioning system itself, or the indoor temperature may also be obtained through an external temperature sensor, as long as the controller can obtain the indoor temperature of the room in which the indoor unit 1 is located.

Further, in step S2, when the indoor unit 1 is in a turned-off state, the controller can obtain the temperature of the first pipeline of the indoor unit 1 through the first temperature sensor, and obtain the temperature of the second pipeline of the indoor unit 1 through the second temperature sensor; it can be understood that when the indoor unit 1 is in the turned-off state, there is almost no refrigerant flowing in the first pipeline and the second pipeline, or only very little refrigerant is flowing in the first pipeline and the second pipeline. In this case, the controller can obtain the temperature of the first pipeline and the temperature of the second pipeline as basic parameters for participating in judging an actual opening degree of the expansion valve, thereby judging the leakage condition of the expansion valve of the indoor unit 1. In addition, it should be noted that the order in which step S1 and step S2 are executed may be set by the controller itself; the controller may also obtain the temperature of the first pipeline and the temperature of the second pipeline first, and then obtain the indoor temperature, or the controller may also obtain these three temperature parameters at the same time. Such changes to the specific execution order do not deviate from the basic principles of the present disclosure, and belong to the scope of protection of the present disclosure.

Further, in step S3, the controller can determine the leakage condition of the expansion valve of the indoor unit 1 according to the indoor temperature of the environment in which the indoor unit 1 is located, the temperature of the first pipeline of the indoor unit 1, and the temperature of the second pipeline of the indoor unit 1; it should be noted that the present disclosure does not impose any restrictions on the specific way of determining. The controller may judge the leakage condition of the expansion valve either by judging a temperature range of each temperature difference or by a preset function. Technicians may set the specific way of determining by themselves according to actual requirements on use, as long as the indoor temperature of the environment in which the indoor unit is located, the temperature of the first pipeline of the indoor unit and the temperature of the second pipeline of the indoor unit can be used as basic parameters in such way of determining, which belongs to the scope of protection of the present disclosure. It can be understood by those skilled in the art that the leakage conditions of the expansion valves of other indoor units may also be judged according to the above steps.

Figure 3:
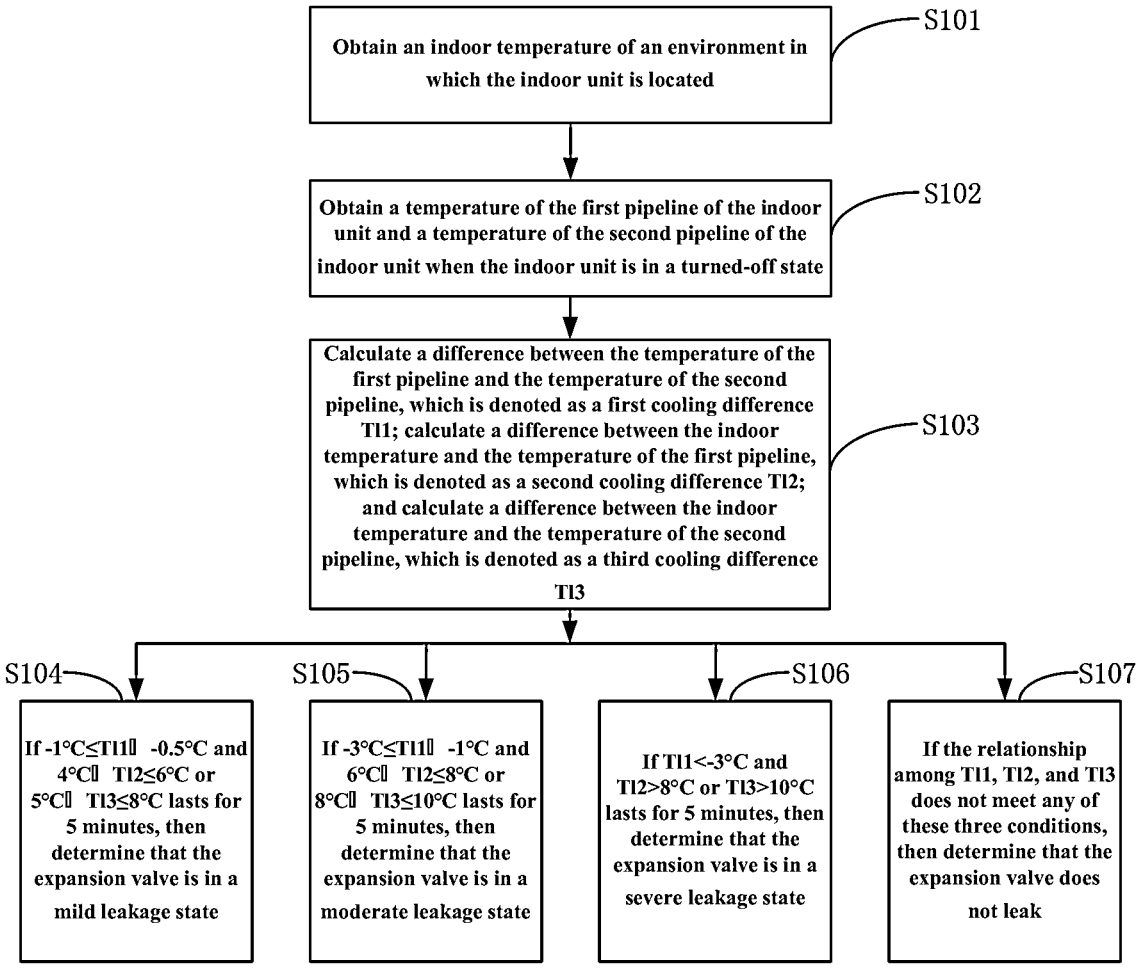
FIG. 3 is a flowchart showing specific steps of a first preferred embodiment of the expansion valve control method of the present disclosure.

Next, reference is made to FIG. 3, which is a flowchart showing specific steps of a first preferred embodiment of the expansion valve control method of the present disclosure. As shown in FIG. 3, based on the multi-connection air conditioning system described in the above preferred embodiment, when the multi-connection air conditioning system is operating in a cooling mode, the preferred embodiment of the expansion valve control method specifically includes the following steps:

S101: obtaining an indoor temperature of an environment in which the indoor unit is located;

S102: obtaining a temperature of the first pipeline of the indoor unit and a temperature of the second pipeline of the indoor unit when the indoor unit is in a turned-off state;

S103: calculating a difference between the temperature of the first pipeline and the temperature of the second pipeline, which is denoted as a first cooling difference Tl1; calculating a difference between the indoor temperature and the temperature of the first pipeline, which is denoted as a second cooling difference Tl2; and calculating a difference between the indoor temperature and the temperature of the second pipeline, which is denoted as a third cooling difference Tl3;

S104: if $-1° C. \leq Tl1 < -0.5° C.$ and [$4° C. < Tl2 \leq 6° C.$ or $5° C. < Tl3 \leq 8° C.$] lasts for 5 minutes, then determining that the expansion valve is in a mild leakage state;

S105: if $-3° C. \leq Tl1 < -1° C.$ and [$6° C. < Tl2 \leq 8° C.$ or $8° C. < Tl3 \leq 10° C.$] lasts for 5 minutes, then determining that the expansion valve is in a moderate leakage state;

S106: if $Tl1 < -3° C.$ and [$Tl2 > 8° C.$ or $Tl3 > 10° C.$] lasts for 5 minutes, then determining that the expansion valve is in a severe leakage state; and S107: if the relationship among Tl1, Tl2, and Tl3 does not meet any of these three conditions, then determining that the expansion valve does not leak.

It should be noted that by taking the determination of the leakage condition of the expansion valve of the indoor unit 1 as an example, when the indoor unit 1 is operating in the cooling mode, the first pipeline is the air outlet pipeline, the second pipeline is the liquid inlet pipeline, and the refrigerant flows from the second pipeline through the indoor unit 1 and then into the first pipeline. When the indoor unit 1 is turned off, that is, when the expansion valve is normally closed, there should be no refrigerant flowing in the indoor unit 1, so the temperature of the first pipeline and the temperature of the second pipeline should be basically the same as the indoor temperature; however, in a case where the expansion valve leaks and cannot be closed normally, since the indoor unit 1 is in the turned-off state and a fan thereof is also in the state of stopping operation at this time, the liquid refrigerant in the liquid inlet pipeline can be evaporated into a gaseous refrigerant only by absorbing heat from part of the air in contact with the pipeline thereof, and there will inevitably be some refrigerant that cannot be evaporated during this process. At the same time, the factor of temperature detection deviation is also taken into consideration. Therefore, when the first cooling difference Tl1≥−0.5° C., it indicates that there is no refrigerant flowing in the indoor unit 1, that is, there is no leakage; and the smaller the first cooling difference Tl1 is, the larger the difference between the temperature of the first pipeline and the temperature of the second pipeline will be, and the more serious the leakage of the expansion valve will be.

Further, in step S101, the controller can obtain the indoor temperature of the room in which the indoor unit 1 is located through the first indoor temperature sensor; it should be noted that the present disclosure does not impose any restrictions on the way in which the controller obtains the indoor temperature. Technicians may obtain the indoor temperature of the room in which the indoor unit 1 is located through the temperature sensor provided by the multi-connection air conditioning system itself, or the indoor temperature may be obtained through an external temperature sensor, as long as the controller can obtain the indoor temperature of the room in which the indoor unit 1 is located.

Further, when the indoor unit 1 is in the turned-off state, step S102 is executed, that is, the controller can obtain the temperature of the first pipeline of the indoor unit 1 through the first temperature sensor, and obtain the temperature of the second pipeline of the indoor unit 1 through the second temperature sensor; of course, it should be noted that the order in which step S101 and step S102 are executed may be set by the controller itself; for example, the controller may also obtain the temperature of the first pipeline and the temperature of the second pipeline first, and then obtain the indoor temperature, or the controller may also obtain these three temperature parameters at the same time. Such changes to the specific execution order do not deviate from the basic principles of the present disclosure, and belong to the scope of protection of the present disclosure.

Further, after the controller obtains the indoor temperature of the room in which the indoor unit 1 is located, the temperature of the first pipeline and the temperature of the second pipeline of the indoor unit 1, step S103 is executed, that is, the controller can calculate the difference between the temperature of the first pipeline and the temperature of the second pipeline, which is denoted as the first cooling difference Tl1, calculate the difference between the indoor temperature and the temperature of the first pipeline, which is denoted as the second cooling difference Tl2, and calculate the difference between the indoor temperature and the temperature of the second pipeline, which is denoted as the third cooling difference Tl3. It can be understood by those skilled in the art that although this preferred embodiment judges the leakage condition of the expansion valve by judging a temperature interval in which the first cooling difference Tl1, the second cooling difference Tl2 and the third cooling difference Tl3 are located, it is obvious that technicians may also set other judgment conditions by themselves, as long as the first cooling difference Tl1, the second cooling difference Tl2 and the third cooling difference Tl3 are used as parameters for participating in the judgment in the judgment process, which belongs to the scope of protection of the present disclosure.

Further, in the preferred embodiment of the present disclosure, the controller judges the leakage condition of the expansion valve by judging a temperature interval in which the first cooling difference Tl1, the second cooling difference Tl2 and the third cooling difference Tl3 are located. Specifically, if the duration of −1° C.≤Tl1<−0.5° C. reaches 5 minutes, and the duration of 4° C.<Tl2≤6° C. reaches 5 minutes or the duration of 5° C.<Tl3≤8° C. reaches 5 minutes, then the controller judges that the expansion valve is in the mild leakage state; if the duration of −3° C.≤Tl1<−1° C. reaches 5 minutes, and the duration of 6° C.≤Tl2≤8° C. reaches 5 minutes or the duration of 8° C.≤Tl3≤10° C. reaches 5 minutes, then the controller judges that the expansion valve is in the moderate leakage state; and meanwhile, if the duration of Tl1<−3° C. reaches 5 minutes, and the duration of Tl2>8° C. reaches 5 minutes or the duration of Tl3>10° C. reaches 5 minutes, then the controller judges that the expansion valve is in the severe leakage state; in addition, if the relationship among Tl1, Tl2 and Tl3 does not meet any of the above three conditions, the controller judges that the expansion valve does not leak, that is, the expansion valve can be normally closed and no leakage occurs in the closed state. It should be noted that preset cooling differences used in this preferred embodiment are all preferred values obtained after multiple times of tests; however, it is obvious that these specific values are only exemplary, and technicians may set these specific values by themselves according to actual requirements on use. In addition, although the first preset duration in this preferred embodiment is 5 minutes, it is obvious that technicians may also set the length of the first preset duration according to actual requirements on use.

Figure 4:
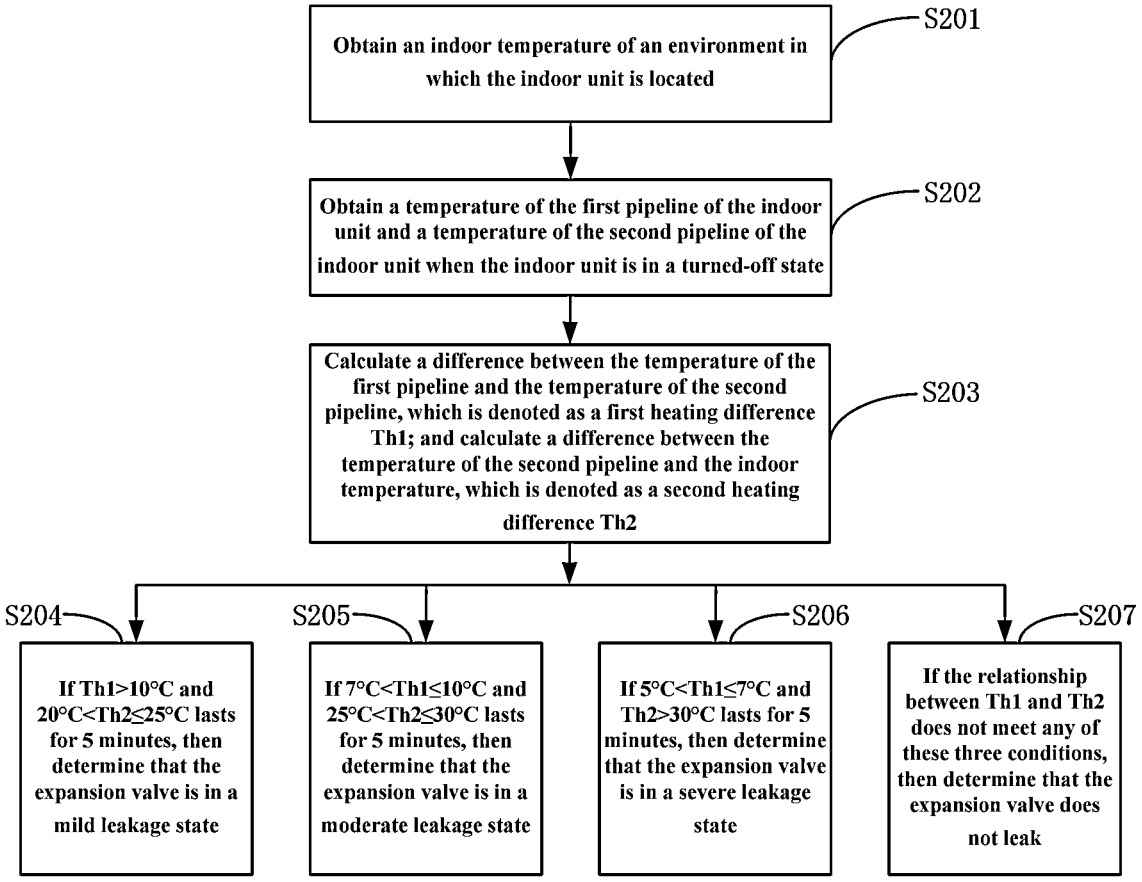
FIG. 4 is a flowchart showing specific steps of a second preferred embodiment of the expansion valve control method of the present disclosure.

Next, reference is made to FIG. 4, which is a flowchart showing specific steps of a second preferred embodiment of the expansion valve control method of the present disclosure. As shown in FIG. 4, based on the multi-connection air conditioning system described in the above preferred embodiment, when the multi-connection air conditioning system is operating in a heating mode, the preferred embodiment of the expansion valve control method specifically includes the following steps:

- S201: obtaining an indoor temperature of an environment in which the indoor unit is located;
- S202: obtaining a temperature of the first pipeline of the indoor unit and a temperature of the second pipeline of the indoor unit when the indoor unit is in a turned-off state;
- S203: calculating a difference between the temperature of the first pipeline and the temperature of the second pipeline, which is denoted as a first heating difference Th1; and calculating a difference between the temperature of the second pipeline and the indoor temperature, which is denoted as a second heating difference Th2;
- S204: if Th1>10° C. and 20° C.≤Th2≤25° C. lasts for 5 minutes, then determining that the expansion valve is in a mild leakage state;
- S205: if 7° C.<Th1≤10° C. and 25° C.<Th2≤30° C. lasts for 5 minutes, then determining that the expansion valve is in a moderate leakage state;
- S206: if 5° C.<Th1≤7° C. and Th2>30° C. lasts for 5 minutes, then determining that the expansion valve is in a severe leakage state; and
- S207: if the relationship between Th1 and Th2 does not meet any of these three conditions, then determining that the expansion valve does not leak.

It should be noted that by taking the determination of the leakage condition of the expansion valve of the indoor unit 1 as an example, when the indoor unit 1 is operating in the heating mode, the first pipeline is the air inlet pipeline, the second pipeline is the liquid outlet pipeline, and the refrigerant flows from the first pipeline through the indoor unit 1 and then into the second pipeline. When the indoor unit 1 is turned off, the expansion valve needs to maintain a small opening degree under normal conditions. Of course, it is only a small opening degree. Although the indoor unit 1 is in the turned-off state and the fan thereof is in the state of stopping operation at this time, the gaseous refrigerant in the air inlet pipeline can be liquefied into a liquid refrigerant only by releasing heat to part of the air in contact with the pipeline thereof; however, since the opening degree of the expansion valve is very small at this time, the high-temperature gaseous refrigerant flowing through the first pipeline basically all becomes a medium-temperature liquid refrigerant. In this case, the first heating difference Th1 is usually relatively large, that is, the temperature difference between the air inlet pipeline and the liquid outlet pipeline is relatively large. In case of leakage in the expansion valve, due to the increase of the gaseous refrigerant flowing through the pipeline, when the fan is not running, there must be some high-temperature gaseous refrigerant that cannot be cooled into liquid refrigerant, thus making the temperature of the second pipeline become higher and the first heating difference Th1 become smaller; it can be seen that the smaller the first heating difference Th1 is, that is, the smaller the temperature difference between the air inlet pipeline and the liquid outlet pipeline is, the more gaseous refrigerant flows through the pipeline, that is, the more serious the leakage of the expansion valve is.

Further, in step S201, the controller can obtain the indoor temperature of the room in which the indoor unit 1 is located through the first indoor temperature sensor; it should be noted that the present disclosure does not impose any restrictions on the way in which the controller obtains the indoor temperature. Technicians may obtain the indoor temperature of the room in which the indoor unit 1 is located through the temperature sensor provided by the multi-connection air conditioning system itself, or the indoor temperature may be obtained through an external temperature sensor, as long as the controller can obtain the indoor temperature of the room in which the indoor unit 1 is located.

Further, when the indoor unit 1 is in the turned-off state, step S202 is executed, that is, the controller can obtain the temperature of the first pipeline of the indoor unit 1 through the first temperature sensor, and obtain the temperature of the second pipeline of the indoor unit 1 through the second temperature sensor; of course, it should be noted that the order in which step S201 and step S202 are executed may be set by the controller itself; for example, the controller may also obtain the temperature of the first pipeline and the temperature of the second pipeline first, and then obtain the indoor temperature, or the controller may also obtain these three temperature parameters at the same time. Such changes to the specific execution order do not deviate from the basic principles of the present disclosure, and belong to the scope of protection of the present disclosure.

Further, after the controller obtains the indoor temperature of the room in which the indoor unit 1 is located, the temperature of the first pipeline and the temperature of the second pipeline of the indoor unit 1, step S203 is executed, that is, the controller can calculate the difference between the temperature of the first pipeline and the temperature of the second pipeline, which is denoted as the first heating difference Th1, and calculate the difference between the temperature of the second pipeline and the indoor temperature, which is denoted as the second heating difference Th2. It can be understood by those skilled in the art that although this preferred embodiment judges the leakage condition of the expansion valve by judging a temperature interval in which the first heating difference Th1 and the second heating difference Th2 are located, it is obvious that technicians may also set other judgment conditions by themselves, as long as the first heating difference Th1 and the second heating difference Th2 are used as parameters for participating in the judgment in the judgment process, which belongs to the scope of protection of the present disclosure.

Further, in the preferred embodiment of the present disclosure, the controller judges the leakage condition of the expansion valve by judging a temperature interval in which the first heating difference Th1 and the second heating difference Th2 are located. Specifically, if the durations of Th1>10° C. and 20° C.<Th2≤25° C. each reach 5 minutes, then the controller judges that the expansion valve is in the mild leakage state; if the durations of 7° C.<Th1≤10° C. and 25° C.<Th2≤30° C. each reach 5 minutes, then the controller judges that the expansion valve is in the moderate leakage state; and if 5° C.<Th1≤7° C. and Th2>30° C. each reach 5 minutes, then the controller judges that the expansion valve is in the severe leakage state; in addition, if the relationship between Th1 and Th2 does not meet any of the above three conditions, the controller judges that the expansion valve does not leak, that is, the expansion valve can be normally closed and no leakage occurs in the closed state. It should be noted that preset heating differences used in this preferred embodiment are all preferred values obtained after multiple times of tests; however, it is obvious that these specific values are only exemplary, and technicians may set these specific values by themselves according to actual requirements on use. In addition, although the second preset duration in this preferred embodiment is 5 minutes, it is obvious that technicians may also set the length of the second preset duration according to actual requirements on use.

After judging the leakage condition of the expansion valve based on the method provided in the above preferred embodiment, the controller can try to automatically solve the leakage problem of the expansion valve by controlling the action of the expansion valve. The specific control method is described as follows.

In a case where the controller judges that the expansion valve is in the mild leakage state, the controller can control the expansion valve to be further closed by a first preset opening degree on the basis of the current closed state. For example, in a case where the specification of the expansion valve is 500 steps, when the multi-connection air conditioning system is in the cooling mode, if the expansion valve has the mild leakage phenomenon, the controller controls the expansion valve to be further closed by 200 steps, so that the opening degree of the expansion valve can be further reduced, and then the controller tries to close the expansion valve completely. It should be noted that when the expansion valve has the mild leakage phenomenon, this leakage phenomenon is often caused by a manufacturing error of the expansion valve or out-of-step of adjustment of a valve body of the expansion valve. In this case, further reducing the opening degree of the expansion valve can often solve this leakage problem. In addition, if the expansion valve is still in the mild leakage state after the third preset duration has elapsed, the controller can again control the expansion valve to be further closed by the first preset opening degree based on the current closed state, so as to try to solve the mild leakage phenomenon again. Preferably, the third preset duration is 30 minutes. Of course, technicians may also set the length of the third preset duration by themselves according to actual requirements on use.

In a case where the controller judges that the expansion valve is in the moderate leakage state, the controller can control the expansion valve to be further closed by a second preset opening degree on the basis of the current closed state, in which the second preset opening degree is larger than the first preset opening degree. For example, in a case where the specification of the expansion valve is 500 steps, when the multi-connection air conditioning system is in the cooling mode, if the expansion valve has the moderate leakage phenomenon, the controller controls the expansion valve to be further closed by 500 steps, so that the opening degree of the expansion valve can be further reduced, and then the controller tries to close the expansion valve completely. It should be noted that when the expansion valve has the moderate leakage phenomenon, this moderate leakage phenomenon is often caused by a severe manufacturing error of the expansion valve or severe out-of-step of adjustment of a valve body of the expansion valve. In this case, the controller can try to solve this leakage problem by greatly reducing the opening degree of the expansion valve. In addition, if the expansion valve is still in the leakage state after the fourth preset duration has elapsed, the controller again controls the expansion valve to be further closed by the second preset opening degree on the basis of the current closed state, so as to try to solve the leakage phenomenon again. Preferably, the fourth preset duration is 30 minutes. Of course, technicians may also set the length of the fourth preset duration by themselves according to actual requirements on use. In a case where the number of times the controller controls the expansion valve to be closed by the second preset opening degree reaches the first preset number of times, if the expansion valve is still in the leakage state, it indicates that the leakage phenomenon of the expansion valve is not caused by the severe manufacturing error of the expansion valve or severe out-of-step of adjustment of the valve body of the expansion valve. Therefore, the controller still needs to try other control methods to solve the leakage problem. It should be noted that preferably, the first preset number of times is 3. Of course, technicians may also set the specific value of the first preset number of times by themselves according to actual requirements on use. As a possibility, the leakage problem of the expansion valve may be caused by existence of impurities in the valve body; in view of this, the controller can control the expansion valve to be opened by the third preset opening degree, so that the refrigerant can flow through the valve body of the expansion valve, and then try to wash away the impurities in the valve body; at the same time, in order to effectively ensure the degree of heat exchange of the refrigerant and avoid the problem of flood-back in the air conditioning system, the controller also has to control the fan of the indoor unit to be turned on so as to speed up the heat exchange process of the refrigerant; after the fifth preset duration has elapsed, the controller can control the expansion valve to be closed by the fourth preset opening degree so as to try to close the expansion valve to a preset state; then, the controller controls the fan of the indoor unit to be turned off to complete a deep self-repair operation. As a preferred example, if the specification of the expansion valve is 500 steps, the controller can control the expansion valve to be opened by 32 steps first, that is, a minimum opening degree for the refrigerant to flow can be met, so as to ensure the flow of the refrigerant; at the same time, the controller controls the fan of the indoor unit to be turned on at a minimum rotational speed so as not to affect the user experience; after 2 minutes, the controller controls the expansion valve to be closed by 700 steps; finally, the controller controls the fan of the indoor unit to be turned off. After completing a deep self-repair operation and the sixth preset duration has elapsed, the controller can judge the leakage condition of the expansion valve again. If the controller judges that the expansion valve still leaks, the controller can control the indoor unit to perform a deep self-repair operation again. Preferably, the sixth preset duration is 30 minutes. Of course, technicians may also set the specific value of the sixth preset duration by themselves according to actual requirements on use. In addition, if the leakage phenomenon still exists after the indoor unit has performed the deep self-repair operation for three times, it indicates that the expansion valve has a fault that cannot be repaired by the expansion valve itself. In this case, the multi-connection air conditioning system can feed information about the fault of the expansion valve back to technicians, so that technicians can repair the expansion valve in time to avoid greater losses.

When the controller judges that the expansion valve is in the severe leakage state, the controller can control the expansion valve to be opened by the fifth preset opening degree, so that the refrigerant can flow through the valve body of the expansion valve, and then try to wash away the impurities in the valve body; at the same time, in order to effectively ensure the degree of heat exchange of the refrigerant and avoid the problem of flood-back in the air conditioning system, the controller also has to control the fan of the indoor unit to be turned on, so as to speed up the heat exchange process of the refrigerant; after the seventh preset duration has elapsed, the controller controls the expansion valve to be closed by the sixth preset opening degree, so as to try to close the expansion valve to a preset state; then, the controller controls the fan of the indoor unit to be turned off, thereby completing a deep self-repair operation. As a preferred example, if the specification of the expansion valve is 500 steps, the controller can control the expansion valve to be opened by 32 steps first, that is, a minimum opening degree for the refrigerant to flow can be met, so as to ensure the flow of the refrigerant; at the same time, the controller controls the fan of the indoor unit to be turned on at a minimum rotational speed so as not to affect the user experience; after 2 minutes, the controller controls the expansion valve to be closed by 700 steps; finally, the controller controls the fan of the indoor unit to be turned off. After completing a deep self-repair operation and the eighth preset duration has elapsed, the controller can judge the leakage condition of the expansion valve again. If the controller judges that the expansion valve still leaks, the controller can control the indoor unit to perform a deep self-repair operation again. Preferably, the eighth preset duration is 30 minutes. Of course, technicians may also set the specific value of the eighth preset duration by themselves according to actual requirements on use. In addition, if the leakage phenomenon still exists after the indoor unit has performed the deep self-repair operation for three times, it indicates that the expansion valve has a fault that cannot be repaired by the expansion valve itself. In this case, the multi-connection air conditioning system can feed information about the fault of the expansion valve back to technicians, so that technicians can repair the expansion valve in time to avoid greater losses.

Finally, it should be noted that the above embodiments are all preferred implementations of the present disclosure, and they are not intended to limit the scope of protection of the present disclosure. When applying the present disclosure in practice, those skilled in the art can appropriately add or delete some of the steps as needed, or exchange the order between different steps. Such changes do not go beyond the basic principles of the present disclosure, and belong to the scope of protection of the present disclosure.

Hitherto, the preferred implementations of the present disclosure have been described in conjunction with the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. An expansion valve control method for a multi-connection air conditioning system, the multi-connection air conditioning system comprising an outdoor unit and a plurality of indoor units connected to the outdoor unit, each of the indoor units being connected to the outdoor unit through a first pipeline and a second pipeline, one of the first pipeline and the second pipeline being a refrigerant inflow pipeline, and the other of the first pipeline and the second pipeline being a refrigerant outflow pipeline, and the expansion valve control method comprises:

obtaining an indoor temperature of an environment in which the indoor unit is located;

obtaining a temperature of the first pipeline of the indoor unit and a temperature of the second pipeline of the indoor unit when the indoor unit is in a turned-off state; and determining a leakage condition of an expansion valve of the indoor unit according to the indoor temperature of the environment in which the indoor unit is located, the temperature of the first pipeline of the indoor unit, and the temperature of the second pipeline of the indoor unit, wherein when the indoor unit is in a cooling mode, the determining of the leakage condition of the expansion valve of the indoor unit according to the indoor temperature of the environment in which the indoor unit is located, the temperature of the first pipeline of the indoor unit, and the temperature of the second pipeline of the indoor unit comprises:

determining the leakage condition of the expansion valve of the indoor unit according to a difference between the temperature of the first pipeline of the indoor unit and the temperature of the second pipeline of the indoor unit, and a difference between the indoor temperature of the environment in which the indoor unit is located and the temperature of the first pipeline of the indoor unit or a difference between the indoor temperature of the environment in which the indoor unit is located and the temperature of the second pipeline of the indoor unit; and wherein the determining of the leakage condition of the expansion valve of the indoor unit according to the difference between the temperature of the first pipeline of the indoor unit and the temperature of the second pipeline of the indoor unit, and the difference between the indoor temperature of the environment in which the indoor unit is located and the temperature of the first pipeline of the indoor unit or the difference between the indoor temperature of the environment in which the indoor unit is located and the temperature of the second pipeline of the indoor unit comprises:

if a duration in which a first cooling difference is larger than or equal to a first preset cooling difference and smaller than a second preset cooling difference reaches a first preset duration, and a duration in which a second cooling difference is larger than a third preset cooling difference and smaller than or equal to a fourth preset cooling difference reaches the first preset duration or a duration in which a third cooling difference is larger than a fifth preset cooling difference and smaller than or equal to a sixth preset cooling difference reaches the first preset duration, then determining that the expansion valve of the indoor unit is in a mild leakage state;

if a duration in which the first cooling difference is larger than or equal to a seventh preset cooling difference and smaller than the first preset cooling difference reaches the first preset duration, and a duration in which the second cooling difference is larger than the fourth preset cooling difference and smaller than or equal to an eighth preset cooling difference reaches the first preset duration or a duration in which the third cooling difference is larger than the sixth preset cooling difference and smaller than or equal to a ninth preset cooling difference reaches the first preset duration, then determining that the expansion valve of the indoor unit is in a moderate leakage state; and if a duration in which the first cooling difference is smaller than the seventh preset cooling difference reaches the first preset duration, and a duration in which the second cooling difference is larger than the eighth preset cooling difference reaches the first preset duration or a duration in which the third cooling difference is larger than the ninth preset cooling difference reaches the first preset duration, then determining that the expansion valve of the indoor unit is in a severe leakage state;

wherein the first cooling difference is the difference between the temperature of the first pipeline of the indoor unit and the temperature of the second pipeline of the indoor unit, the second cooling difference is the difference between the indoor temperature of the environment in which the indoor unit is located and the temperature of the first pipeline of the indoor unit, and the third difference is the difference between the indoor temperature of the environment in which the indoor unit is located and the temperature of the second pipeline of the indoor unit.

2. The expansion valve control method according to claim 1, wherein when the indoor unit is in a heating mode, the determining of the leakage condition of the expansion valve of the indoor unit according to the indoor temperature of the environment in which the indoor unit is located, the temperature of the first pipeline of the indoor unit, and the temperature of the second pipeline of the indoor unit" comprises:

determining the leakage condition of the expansion valve of the indoor unit according to a difference between the temperature of the first pipeline of the indoor unit and the temperature of the second pipeline of the indoor unit, and a difference between the temperature of the second pipeline of the indoor unit and the indoor temperature of the environment in which the indoor unit is located.

3. The expansion valve control method according to claim 2, wherein the determining of the leakage condition of the expansion valve of the indoor unit according to the difference between the temperature of the first pipeline of the indoor unit and the temperature of the second pipeline of the indoor unit, and the difference between the temperature of the second pipeline of the indoor unit and the indoor temperature of the environment in which the indoor unit is located comprises:

if a duration in which a first heating difference is larger than a first preset heating difference reaches a second preset duration, and a duration in which a second heating difference is larger than a second preset heating difference and smaller than or equal to a third preset heating difference reaches the second preset duration, then determining that the expansion valve of the indoor unit is in a mild leakage state;

if a duration in which the first heating difference is larger than a fourth preset heating difference and smaller than or equal to the first preset heating difference reaches the second preset duration, and a duration in which the second heating difference is larger than the third preset heating difference and smaller than or equal to a fifth preset heating difference reaches the second preset duration, then determining that the expansion valve of the indoor unit is in a moderate leakage state; and if a duration in which the first heating difference is larger than a sixth preset heating difference and smaller than or equal to the fourth preset heating difference reaches the second preset duration, and a duration in which the second heating difference is larger than the fifth preset heating difference reaches the second preset duration, then determining that the expansion valve of the indoor unit is in a severe leakage state;

wherein the first heating difference is the difference between the temperature of the first pipeline of the indoor unit and the temperature of the second pipeline of the indoor unit, and the second heating difference is the difference between the temperature of the second pipeline of the indoor unit and the indoor temperature of the environment in which the indoor unit is located.

4. The expansion valve control method according to claim 1, wherein the first preset cooling difference is −1° C., the second preset cooling difference is −0.5° C., the third preset cooling difference is 4° C., the fourth preset cooling difference is 6° ° C., the fifth preset cooling difference is 5° C., the sixth preset cooling difference is 8° C., the seventh preset cooling difference is −3° C., the eighth preset cooling difference is 8° C., the ninth preset cooling difference is 10° C., and the first preset duration is 5 minutes; or the first preset heating difference is 10° C., the second preset heating difference is 20° C., the third preset heating difference is 25° C., the fourth preset heating difference is 7° C., the fifth preset heating difference is 30° C., the sixth preset heating difference is 5° C., and the second preset duration is 5 minutes.

5. The expansion valve control method according to claim 1, wherein if the expansion valve of the indoor unit is in the mild leakage state, the expansion valve control method further comprises:

controlling the expansion valve to be closed by a first preset opening degree; and executing the above step again, if the expansion valve is still in the mild leakage state after a third preset duration has elapsed.

6. The expansion valve control method according to claim 5, wherein if the expansion valve of the indoor unit is in the moderate leakage state, the expansion valve control method further comprises:

controlling the expansion valve to be closed by a second preset opening degree; and executing the above step again, if the expansion valve is still in the leakage state after a fourth preset duration has elapsed, wherein the second preset opening degree is larger than the first preset opening degree.

7. The expansion valve control method according to claim 6, wherein if the expansion valve is still in the leakage state in a case where the number of times the expansion valve is controlled to be closed by the second preset opening degree reaches a first preset number of times, the control method further comprises:

controlling the expansion valve to be opened by a third preset opening degree;

controlling a fan of the indoor unit to be turned on;

controlling the expansion valve to be closed by a fourth preset opening degree after a fifth preset duration has elapsed;

controlling the fan of the indoor unit to be turned off; and executing the above steps again, if the expansion valve is still in the leakage state after a sixth preset duration has elapsed, wherein the fourth preset opening degree is larger than the third preset opening degree.

8. The expansion valve control method according to claim 1, wherein if the expansion valve of the indoor unit is in the severe leakage state, the expansion valve control method further comprises:

controlling the expansion valve to be opened by a fifth preset opening degree;

controlling a fan of the indoor unit to be turned on;

controlling the expansion valve to be closed by a sixth preset opening degree after a seventh preset duration has elapsed;

controlling the fan of the indoor unit to be turned off; and executing the above steps again, if the expansion valve is still in the leakage state after an eighth preset duration has elapsed, wherein the sixth preset opening degree is larger than the fifth preset opening degree.

9. The expansion valve control method according to claim 3, wherein the first preset cooling difference is −1° C., the second preset cooling difference is −0.5° C., the third preset cooling difference is 4° C., the fourth preset cooling difference is 6° C., the fifth preset cooling difference is 5° C., the sixth preset cooling difference is 8° C., the seventh preset cooling difference is −3° C., the eighth preset cooling difference is 8° C., the ninth preset cooling difference is 10° C., and the first preset duration is 5 minutes; or the first preset heating difference is 10° C., the second preset heating difference is 20° ° C., the third preset heating difference is 25° C., the fourth preset heating difference is 7° C., the fifth preset heating difference is 30° C., the sixth preset heating difference is 5° C., and the second preset duration is 5 minutes.

10. The expansion valve control method according to claim 3, wherein if the expansion valve of the indoor unit is in the mild leakage state, the expansion valve control method further comprises:

controlling the expansion valve to be closed by a first preset opening degree; and executing the above step again, if the expansion valve is still in the mild leakage state after a third preset duration has elapsed.

11. The expansion valve control method according to claim 10, wherein if the expansion valve of the indoor unit is in the moderate leakage state, the expansion valve control method further comprises:

controlling the expansion valve to be closed by a second preset opening degree; and executing the above step again, if the expansion valve is still in the leakage state after a fourth preset duration has elapsed, wherein the second preset opening degree is larger than the first preset opening degree.

12. The expansion valve control method according to claim 11, wherein if the expansion valve is still in the leakage state in a case where the number of times the expansion valve is controlled to be closed by the second preset opening degree reaches a first preset number of times, the control method further comprises:

controlling the expansion valve to be opened by a third preset opening degree;

controlling a fan of the indoor unit to be turned on;

controlling the expansion valve to be closed by a fourth preset opening degree after a fifth preset duration has elapsed;

controlling the fan of the indoor unit to be turned off; and executing the above steps again, if the expansion valve is still in the leakage state after a sixth preset duration has elapsed, wherein the fourth preset opening degree is larger than the third preset opening degree.

13. The expansion valve control method according to claim 3, wherein if the expansion valve of the indoor unit is in the severe leakage state, the expansion valve control method further comprises:

controlling the expansion valve to be opened by a fifth preset opening degree;

controlling a fan of the indoor unit to be turned on;

controlling the expansion valve to be closed by a sixth preset opening degree after a seventh preset duration has elapsed;

controlling the fan of the indoor unit to be turned off; and executing the above steps again, if the expansion valve is still in the leakage state after an eighth preset duration has elapsed, wherein the sixth preset opening degree is larger than the fifth preset opening degree.

* * * * *